US007065913B2

(12) United States Patent
Lizarralde et al.

(10) Patent No.: US 7,065,913 B2
(45) Date of Patent: Jun. 27, 2006

(54) MUZZLE-LOADING FIREARM WITH PIVOTING BLOCK ACTION

(75) Inventors: Inigo Lizarralde, Bergara (ES); Julian Echeberria, Eibar (ES)

(73) Assignee: Blackpowder Products, Inc., Norcross, GA (US)

( * ) Notice: Subject to any disclaimer, the term of this patent is extended or adjusted under 35 U.S.C. 154(b) by 193 days.

(21) Appl. No.: 10/706,317

(22) Filed: Nov. 12, 2003

(65) Prior Publication Data

US 2004/0134112 A1 Jul. 15, 2004

Related U.S. Application Data

(60) Provisional application No. 60/425,950, filed on Nov. 12, 2002, provisional application No. 60/443,936, filed on Jan. 31, 2003, provisional application No. 60/497,420, filed on Aug. 22, 2003.

(51) Int. Cl.
*F41C 7/00* (2006.01)

(52) U.S. Cl. ..... 42/51; 42/26; 42/28; 42/34

(58) Field of Classification Search ..... 42/51, 42/26, 28, 34

See application file for complete search history.

(56) References Cited

U.S. PATENT DOCUMENTS

| | | | | |
|---|---|---|---|---|
| 14,491 A | | 3/1856 | Burnside | |
| 17,233 A | | 5/1857 | Read | |
| 42,702 A | | 5/1864 | Trulender | |
| 212,593 A | | 2/1879 | Deeley et al. | |
| 214,098 A | | 4/1879 | Buck | |
| 250,495 A | | 12/1881 | Burnett | |
| 261,648 A | | 7/1882 | Altmaier | |
| 291,153 A | | 1/1884 | Cole | |
| 939,142 A | | 11/1909 | Lewis | |
| 1,059,477 A | | 4/1913 | Lewis | |
| 1,157,656 A | | 10/1915 | Swebilius et al. | |
| 1,448,297 A | | 3/1923 | Hedrick | |
| 1,459,108 A | | 6/1923 | Lewis | |
| 1,494,105 A | | 3/1924 | Elder | |
| 1,790,482 A | | 1/1931 | Mossberg | |
| 1,795,111 A | | 3/1931 | Dygert et al. | |
| 2,627,687 A | | 2/1953 | Arbuckle | |
| 3,526,051 A | * | 9/1970 | Delis et al. | 42/28 |
| 4,452,001 A | * | 6/1984 | Compton | 42/23 |
| 4,854,065 A | | 8/1989 | French et al. | |
| 5,435,089 A | | 7/1995 | Rodney, Jr. | |
| 5,644,861 A | | 7/1997 | Knight | |
| 5,651,203 A | | 7/1997 | Knight | |
| 5,680,722 A | | 10/1997 | French et al. | |
| 5,722,193 A | * | 3/1998 | Post | 42/51 |
| 5,907,920 A | | 6/1999 | Laney | |
| 5,915,934 A | | 6/1999 | Knight et al. | |

(Continued)

*Primary Examiner*—Michael J. Carone
*Assistant Examiner*—Stewart Knox
(74) *Attorney, Agent, or Firm*—Gardner Groff Santos & Greenwald, PC

(57) ABSTRACT

A muzzle-loading firearm having a barrel and a pivoting firing mechanism. The barrel has a breech plug, a pivoting junction axle. and a blocking axle, and the firing mechanism has a trigger, hammer, striker and notch. The firing mechanism is pivotally attached to the barrel at the pivoting junction axle and the blocking axle is movably aligned in the notch. When the firing mechanism is pivoted, it is guided by the blocking axle in the notch ensuring sufficient clearance between said firing mechanism for easy placement of a percussion cap.

16 Claims, 13 Drawing Sheets

U.S. PATENT DOCUMENTS 6,085,454 A 7/2000 Caudle
6,145,235 A 11/2000 Emerson et al.
6,189,253 B1 2/2001 Knight et al.
6,305,113 B1 10/2001 Calvete
6,314,670 B1 11/2001 Rodney, Jr.
6,604,311 B1 8/2003 Laney et al.

* cited by examiner

MUZZLE-LOADING FIREARM WITH PIVOTING BLOCK ACTION

CROSS-REFERENCE TO RELATED APPLICATIONS

The present application claims the priority benefit of U.S. Provisional Patent Application Ser. No. 60/425,950, filed Nov. 12, 2002; U.S. Provisional Patent Application Ser. No. 60/443,936 filed Jan. 31, 2003; and U.S. Provisional Patent Application Ser. No. 60/497,420, filed Aug. 22, 2003; all of which are hereby incorporated herein by reference in their entireties.

TECHNICAL FIELD

The present invention relates to a firing mechanism for a muzzle-loading firearm, such as a muzzle-loading rifle, shotgun, cannon or the like. This invention relates more specifically toward a pivoting block firing mechanism for a muzzle-loader.

BACKGROUND OF THE INVENTION

In the second half of the $19^{th}$ century, cartridge style rifles became popular and the market for older muzzle-loading designs started to wane. After the introduction of the cartridge style rifle, which fires a pre-assembled cartridge or bullet, firearm manufacturers started developing movable firing mechanisms (movable blocks) to provide access to the firing chamber for replacing a spent cartridge with a fresh one. Eventually, cartridge style rifles were developed with "bolt action" to speed movement of a cartridge into the firing chamber and ultimately repeating rifles were developed that used the explosive power unleashed from the firing of the cartridge itself to remove the spent shell. These developments effectively obviated the need for movable block actions in cartridge style firearms. Meanwhile, developments in the older, outdated muzzle-loading firearms slowed as the muzzle-loading firearms fell out of favor. Not surprisingly, it does not appear that the movable firing mechanisms used in $19^{th}$ century cartridge style firearms were ever adapted to muzzle-loading firearms before the muzzle-loading firearm all but disappeared from manufacture. Now that muzzle-loading firearms have experienced a resurgence in popularity, there is a need for a muzzle-loading firearm that includes a movable firing mechanism to provide convenient access to the breech, as will be explained below.

Hunting with muzzle-loading firearms has become increasingly popular in recent years. Perhaps one of the reasons for this popularity is that some people enjoy manually loading the powder and projectile into the muzzle, and then packing it with the ramrod. As evidence of the increasing popularity of muzzle-loading firearms, some states within the United States have separate hunting seasons for sportsmen using muzzle-loading firearms. Despite their recent increased popularity, muzzle-loading firearms have presented several problems to those that use them.

The muzzle-loading firearms used for hunting can be divided into two major groups. First is the traditional type, which normally is made with the firing mechanism positioned to one side of the barrel. And second is the "in-line" type, which is made to have the firing mechanism "in-line" and includes an ignition system directly behind the barrel, which therefore is substantially "lined up" with the barrel. Both of these types of firearms typically include a barrel, a trigger positioned within a trigger guard, a hammer, a striker, and their corresponding springs.

However, whether they are traditional or in-line, these firearms typically have problems in common. Such deficiencies of the firearms include the following:

- Excessive Residue: The black powder that is used in shooting these firearms typically leaves residue on both the barrel and the firing mechanisms. Therefore, these firearms must be disassembled and cleaned periodically. This disassembly is difficult and time-consuming, and obtaining an acceptable cleaning result without disassembling all, or a substantial part, of the firearm is very difficult. Additionally, the traditional type of muzzle-loading firearms are even more difficult to clean, making the residue problem even more severe.
- Blowback Gas Injuries: Shooting muzzle-loading firearms often causes "blowback gas." This gas, which is a byproduct of the burning of the black powder, can cause injury and burns to the shooter. Typically, the traditional models are safer than the "in-line" ones, as the gas outlet of a traditional model is located to one side of, instead of directly aligned with, the face of the user. However, traditional models face a problem when a left-handed shooter uses a firearm intended to be for a right-handed person.
- Loading Time: The loading time, which includes the time for replacement of the percussion cap, reloading the powder and the bullet and compressing them, is significantly long. This problem is typically worse for in-line models, as access for reloading the percussion caps or other form of primers is very difficult and a user typically must use a special tool for this purpose.
- Barrel Length: Because of the type of powder used, these types of firearms typically have relatively long barrels, making them rather heavy.

In-line muzzle-loading rifles were introduced to the marketplace in recent years to address the cleaning difficulties and the lack of reliability and precision often encountered in traditional muzzle-loaders. The precision of the rifle is typically inversely proportional to the time it takes to shoot, considering the shooting time as the time it takes from when the trigger is pulled until the powder, that expels the bullet, explodes.

As previously discussed, previously known in-line rifles have problems with regard to the blowback gas and with the long reloading times. Additionally, this type of rifle also has another disadvantage in comparison to traditional muzzle-loading rifles, as they often have a longer overall length for a given effective barrel length (i.e., the length of the bore into which the powder charge and bullet are loaded), because the firing mechanism and primer loading action are located behind the barrel (rather than beside it), and similarly may also have a greater weight for a given effective barrel length than traditional side-action rifles.

Therefore, it can be seen that a need yet exists for an improved muzzle-loading firearm with convenient access to the breech for replacing percussion caps and for cleaning. It would be further desirable to minimize or eliminate any additional overall length of a rifle that results from inline placement of the firing mechanism and primer loading action at the breech. It is to the provision of a muzzle-loading firearm meeting these and other needs that the present invention is primarily directed.

SUMMARY OF THE INVENTION

The present invention is an improved muzzle-loading firearm and includes a pivoting firing mechanism set that is pivotally attached to the barrel to allow it to swing down and provide free access to the breech plug in such a way that the percussion cap or primer can be replaced easily. The pivotal range of motion of the pivoting firing mechanism (a pivot block or falling block) allows easy access to the percussion cap in order to replace it, as well as to the breech plug, so it can be disassembled and cleaned out. As used herein, the terms "percussion cap" or "primer" include standard percussion caps as well as 209 shotgun primers and other ignition sources for muzzle-loading firearms.

Generally described, the present invention is an improved muzzle-loading firearm that has a pivotally attached firing mechanism (pivot block) and includes a mechanism for providing a positive prevention of unwanted movement from a blocked position to an unblocked position. The invention preferably also prevents inadvertent tripping of the firing mechanism when the pivot block is swung down to its unblocked position.

One example of the present invention is a muzzle-loading firearm including a barrel and a breach plug situated in a rear end of the barrel and adapted to receive a primer. A pivot block is mounted for pivotal motion relative to the barrel and has a firing mechanism mounted thereto, the firing mechanism including a striker for striking the primer, a hammer for driving the striker, and a trigger for tripping the hammer. The pivot block is adapted for pivotal movement between a blocked position for firing and an unblocked position for providing access to the breech plug for removing a spent primerand replacing it with a fresh primer. Further, a trigger guard preferably is pivotally mounted to the pivot block for movement between three positions: (1) a locked position locking the pivot block in its blocked position; (2) an unlocked, blocked position in which the pivot block is still in its blocked position, but the pivot block is unlocked and ready to be moved therefrom; and (3) an unlocked, unblocked position in which the pivot block has been unblocked, providing access to the breech plug. Preferably, rotation of the trigger guard from the unlocked, blocked position to the unlocked, unblocked position causes the pivot block to move from its blocked position to its unblocked position. Preferably, initial rotation of the trigger guard from its locked position does not move the pivot block, but only unlocks it, and continued rotation of the trigger guard does move the pivot block.

Preferably, the trigger guard is held in its locked, blocked position by a spring clamp. An advantage of the spring clamp arrangement is that it tends to hold the trigger guard in its locked, blocked position, but does not apply a biasing force biasing the trigger guard against movement from the unlocked, blocked position toward the unlocked, unblocked position, thereby making it relatively easy to move the pivot block to its unblocked position. Alternatively, the trigger guard can be biased toward its locked, blocked position by a biasing spring.

Preferably, to prevent unwanted movement of the pivot block from its blocked position to its unblocked position, the trigger guard engages a structural barrier to prevent the pivot block from making this unwanted/unintended movement. To free the pivot block for movement, the trigger guard preferably is moved clear of the barrier, thereby allowing the pivot block to be moved, as by further rotation of the trigger guard or by some other mechanism or technique.

In another example embodiment of the present invention, the muzzle-loading firearm has a barrel and a pivoting firing mechanism. The barrel includes a breach plug, which is inserted substantially at the back end of the barrel, a trigger guard blocking axle, and a pivoting junction axle. The pivoting firing mechanism includes a lineal striker, which is substantially in line with the breach plug and substantially at the rear end of the barrel, and a lineal striker spring, which is substantially between the striker and the breach plug. The firing mechanism also includes a hammer, a hammer spring, a trigger, a trigger spring, and a trigger guard. The hammer preferably includes: a strike end, which is substantially behind the lineal striker and rotationally coupled to the firing mechanism for pivotal impact against the striker when fired; a middle portion having a hammer protuberance and a set back uncocking support; and a hammer lever portion which includes a hammer safety notch and a hammer cocked notch. The firing mechanism preferably also includes: a hammer spring in contact at a first end to the hammer protuberance, a trigger spring, a trigger, and a trigger guard. The trigger preferably includes a trigger uncocked lever, a trigger shooting lever and a trigger safety lever. Additionally the trigger guard includes a pivot-guiding notch, wherein the trigger guard blocking axle is slidingly located within the pivot-guiding notch. In this example embodiment, the combination of the pivot-guiding notch and the trigger guard blocking axle limits the pivoting of the firing mechanism with respect to the barrel. Preferably the pivot-guiding notch is substantially an "L"-shaped notch and when the firing mechanism pivots away from the barrel, the pivot is to a sufficient degree as to allow for sufficient clearance for a percussion cap. It is preferable that the trigger guard has a trigger guard safety lever so that when the firing mechanism pivots away from the barrel, the trigger guard safety lever is aligned with the trigger safety lever, thereby preventing substantial movement of the trigger. It is also preferable that when the trigger uncocked lever is substantially contacting the hammer cocked notch, the trigger spring is pre-loaded. Conversely, after shooting the firearm, the firearm is preferably in a post-shooting position where the hammer strike portion remains substantially in contact with the lineal striker. It is preferable that when the firearm is in the post-shooting position, the trigger guard safety lever is positioned in a manner in relation to the trigger safety lever to substantially prevent the rotation of the firing mechanism.

In yet another example embodiment of the present invention the muzzle-loading firearm has a barrel with a breach plug inserted substantially at the back end of the barrel, a blocking axle and a pivoting axle. The firearm also has a pivoting firing mechanism that has a trigger, a trigger spring, a hammer, a hammer spring, a lineal striker and a striker spring. It is preferable for the trigger guard to have a guiding notch and to have the firing mechanism be pivotally attached at the pivoting axle and the firing mechanism slide within the guiding notch at the blocking axle. It is preferable for the guiding notch to be an "L"-shape notch that has a first portion and a second portion. When the firing mechanism slides along the first portion of the notch, the firing mechanism is unblocked and when the firing mechanism slides along the second portion the lineal striker of the firing mechanism moves away from the barrel of the firearm and provides sufficient clearance for insertion of a percussion cap between the striker and the barrel. It is also preferable for the firing mechanism of the firearm to have a base, which in turn, has a base-hammer protuberance. Additionally the hammer preferably has a hammer protuberance and between these two protuberances is the hammer spring, when the hammer is uncocked, the hammer spring is preferably preloaded due to contact of the one end of the spring 48 against the protuberance 45 and the other end of the spring 48 against the protuberance 74. It is also preferable that when the hammer is in a post-shooting position, the hammer return to the uncocked position by action of the spring 48. The trigger spring is then loaded with sufficient force to force the return of the trigger safety lever to the hammer safety notch, thereby returning the hammer to the un-cocked position.

Another example embodiment of the present invention is a firearm with a barrel having a pivot axle and a blocking axle, a firing mechanism with a guiding notch pivotally attached at the pivot axle, wherein the guiding notch directs the pivoting action of the firing mechanism. As noted, it is preferable that the notch is substantially "L"-shaped. It is also preferable for the firing mechanism to have a trigger with a safety notch, and a trigger guard with a safety lever. Then, as the "L"-shaped notch has a first and a second portion, when the firing mechanism glides between the first and the second portion, the trigger safety notch and the trigger safety lever substantially align and prevent the pulling of the trigger. It is also preferable for the barrel to have an open and a substantially closed end, and for the firing mechanism to further have a lineal striker. As before, the "L"-shaped notch can have a first portion and a second portion; so that when the firing mechanism is sliding in the first portion, the linear striker and the closed end of the barrel are substantially aligned; and when the firing mechanism is in the second portion, there is clearance between the striker and the closed end of the barrel to allow for use of a percussion cap between the striker and the closed end of the barrel.

These and other features and advantages of the present invention will be apparent to those skilled in the art in view of the description and appended drawing figures herein.

BRIEF DESCRIPTION OF THE DRAWINGS

FIG. 3 is a side view of the pivoting firing mechanism of FIG. 1, showing the pivoting mechanism set totally unblocked (swung down).

FIG. 10 is a side view of the pivoting firing mechanism of FIG. 6, showing the pivoting mechanism set closed or blocked and showing the uncocked hammer position.

DETAILED DESCRIPTION OF THE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about" or the like, it will be understood that the particular value forms another embodiment.

Figure 1:
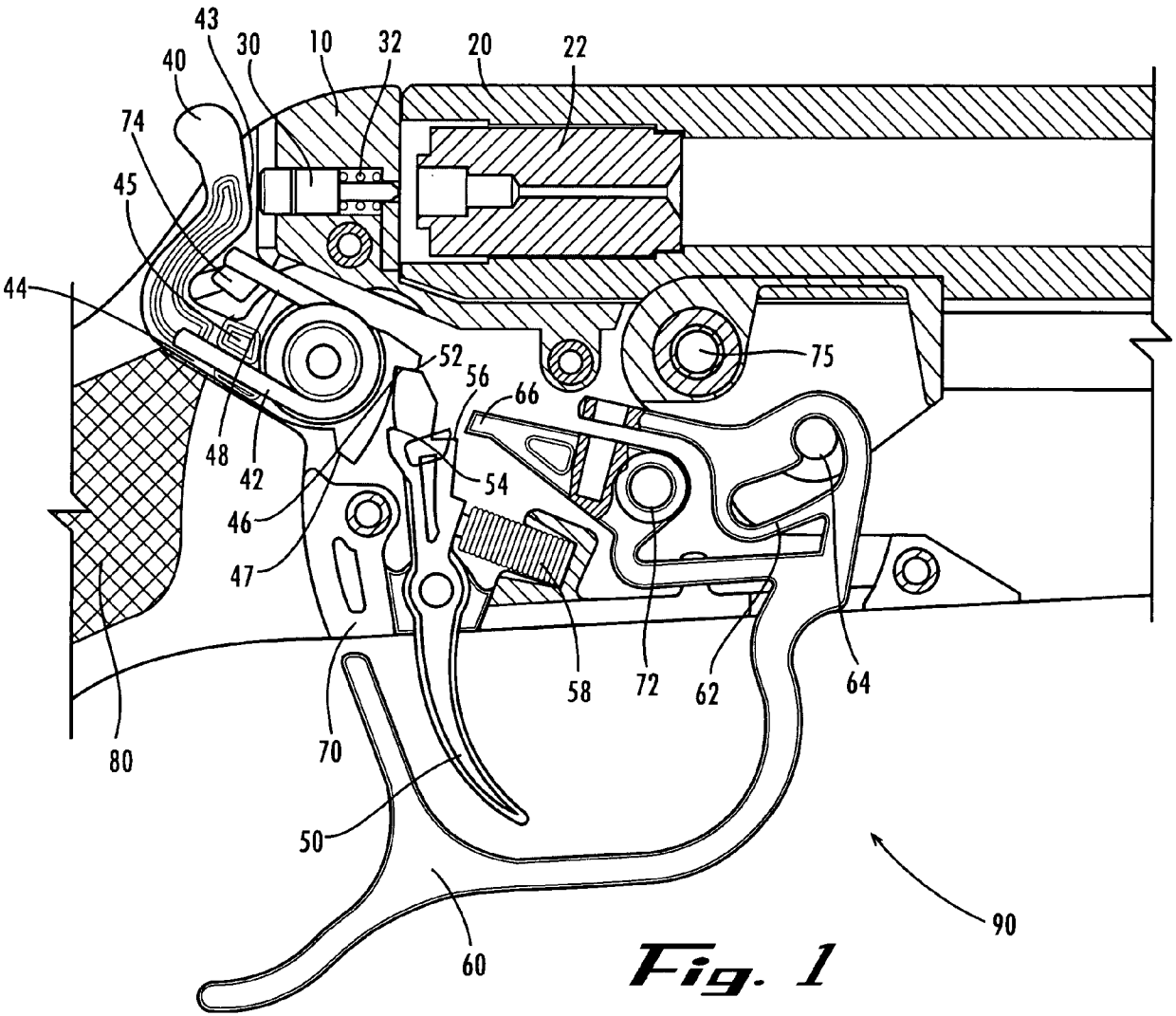
FIG. 1 is a side view of an example of a muzzle-loading firearm of the present invention, showing its pivoting firing mechanism in a closed or uncocked position, where the hammer is also not cocked.

As shown in FIG. 1, which is a lateral view of an example of the present invention in a closed or uncocked position, a muzzle-loading firearm 90 is shown (with some portions of the stock and some portions of the barrel omitted for clarity). The firearm 90 preferably has a pivoting firing mechanism 10, a barrel 20 and a stock 80. The barrel 20 has a front end (not shown) and a back end. At the back end of the barrel 20 a breech plug 22 is inserted. The barrel 20 also includes a pivoting junction axle 75 and a blocking axle 64. The stock 80 is attached at one or more points (not shown) to the barrel 20.

The firing mechanism 10 preferably includes a lineal striker or firing pin 30 and a striker spring 32. As shown, when in the closed position, the striker 30 is aligned with the breech plug 22, and the striker spring is located between the striker 30 and the breech plug 22, to ensure the return of the striker 30 to the position shown in FIG. 1 after shooting the firearm 90.

The firing mechanism 10 preferably also includes a hammer 40 and a hammer spring 42. The hammer 40 has a strike portion 43 that, when the hammer is released forward upon firing the firearm 90, contacts the striker 30, discussed above. The hammer 40 preferably also has a shooting support 44 which act as a pushing support for the hammer. A hammer protuberance 45 is in contact with a first end of the hammer spring 42. The hammer 40 also includes a hammer safety notch 46 and a hammer cocked notch 47, which are also discussed subsequently. Finally, the hammer 40 includes a setback uncocking support 48, which is also discussed subsequently.

The firing mechanism 10 preferably also includes a base 70 which has a base-hammer protuberance 74, which is in contact with a second end of the hammer spring 42. A trigger 50 is preferably included within the firing mechanism 10, which includes a trigger uncocked lever 52, a trigger shooting lever 54 and a trigger safety lever 56. A trigger spring 58 is positioned so as to force the trigger levers 52–54 toward the hammer notches 46–47. When in the closed and uncocked position, the trigger uncocked lever 52 is in contact with hammer safety notch 46, thereby preloading hammer spring 48 between the hammer protuberance 45 and the base-hammer protuberance 74, due to engagement of one end of spring 48 against protuberance 45 and the other end of spring 48 against protuberance 74.

The firing mechanism 10 preferably also includes a trigger guard 60 which has an "L"-shaped notch or track 62 and a trigger guard safety lever 66. The firing mechanism 10 is pivotally attached to the barrel 20 at the pivoting junction axle 75 and the blocking axle 64 is slidingly engaged within the "L"-shaped notch or track 62.

Figure 2:
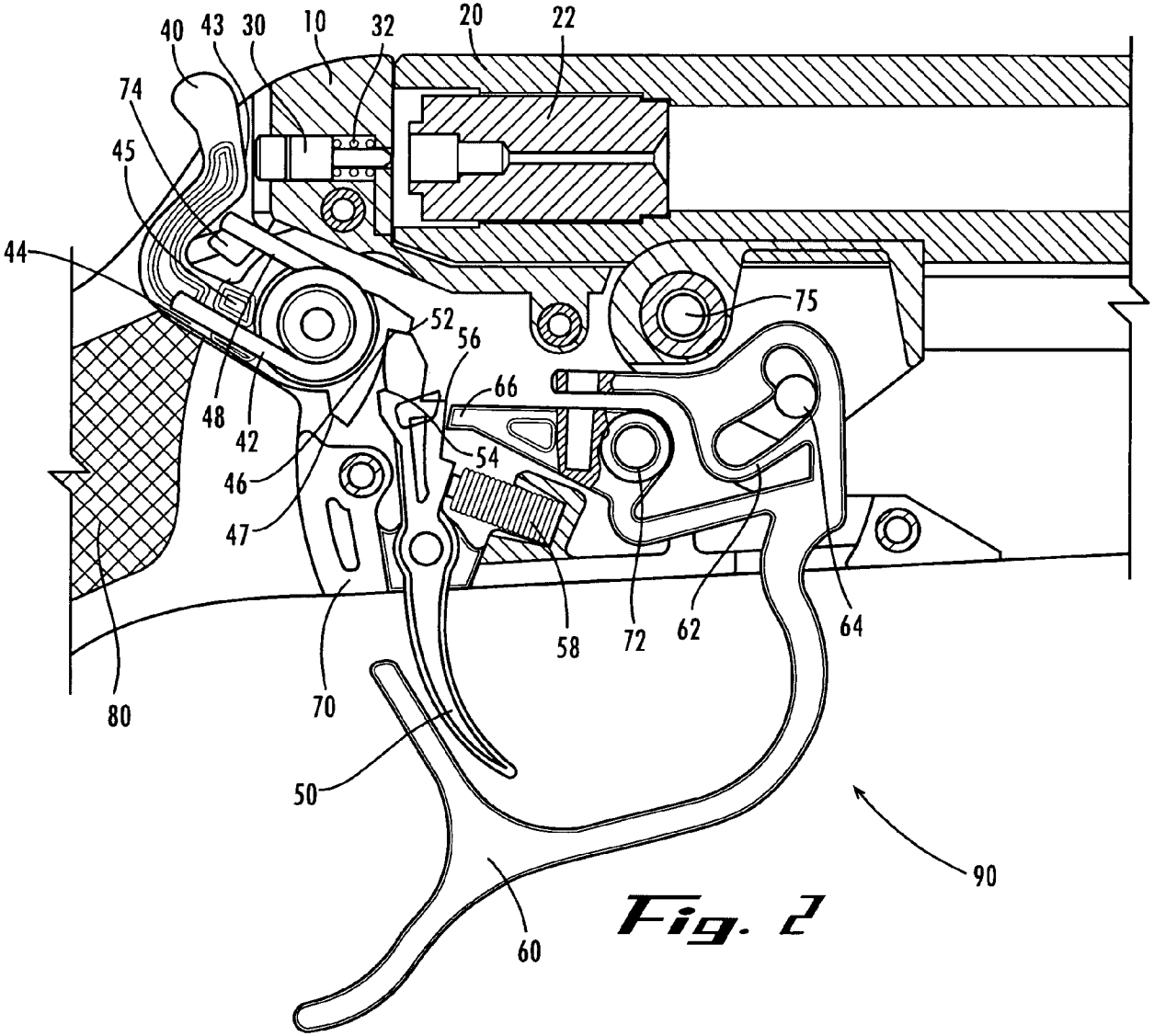
FIG. 2 is a side view of the pivoting firing mechanism of FIG. 1, showing the pivoting mechanism set unlocked and ready to be unblocked.

As shown in FIG. 2, when the firing mechanism 10 is unlocked by sliding the firing mechanism 10 about the blocking axle 64 so that it is between the first and the second positions of the "L"-shaped notch 62, the trigger guard safety lever 66 aligns with the trigger safety lever 56, thereby preventing the movement of the trigger levers 52–54 away from hammer notches 46–47. This effectively prevents the trigger from being tripped when the pivoting firing mechanism is in an unblocked position. In fact, it also prevents the trigger from being tripped when the firing mechanism is unlocked but still blocked, as shown in this figure. It should also be noted that in the present example the trigger guard 60 is substantially closer to the trigger 50 when in this position as compared to the position in FIG. 1.

Now turning to FIG. 3, which depicts the pivoting firing mechanism 10 when completely unblocked, by slidingly moving the "L" shaped notch 62 about the blocking axle 64 so that blocking axle 64 is positioned at the end of the longer, second portion of the notch 62, it can be seen that there is essentially complete clearance for placement of a percussion cap (not shown) in the breech plug 22. Additionally, the striker 30 is drawn back sufficiently to allow for ease of cleaning.

Figure 4:
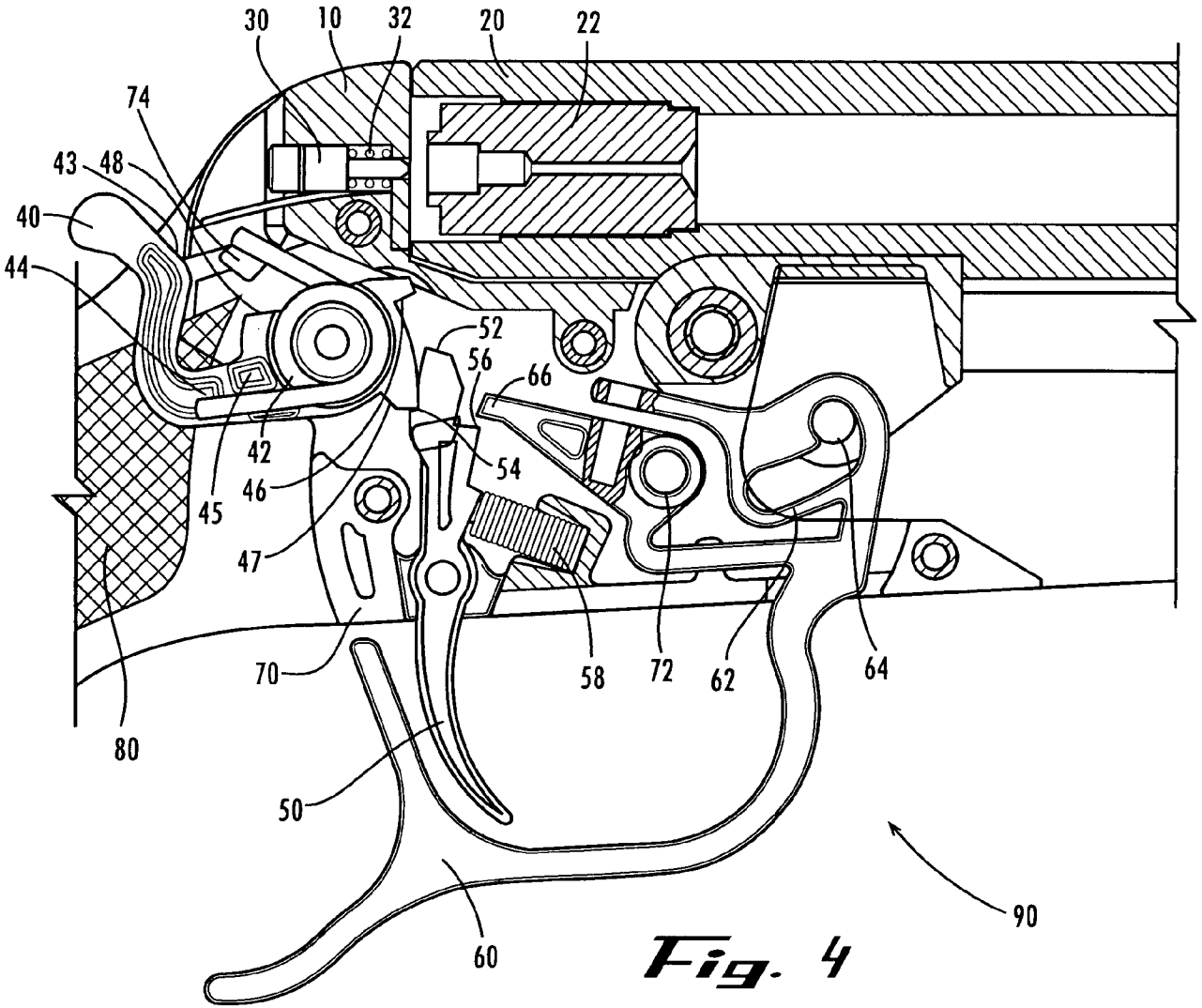
FIG. 4 is a side view of the pivoting firing mechanism of FIG. 1, showing the pivoting mechanism set closed or blocked and the hammer in a cocked position.

Upon examining FIG. 4 we can see the lateral view of the firing mechanism 10 of FIG. 1 when in the closed and cocked position. The hammer 40 is drawn back, fully loading the hammer spring 42. The hammer is held in place by the hammer cocked notch 47 contacting the trigger shooting lever 54. In this position the trigger guard is locked closed by abutment of trigger guard safety lever 66 against trigger safety lever 56. Upon pulling the trigger 50 the trigger shooting lever 54 disengages from the hammer cocked notch 47, and due to the loading of the hammer spring 42, the hammer strike portion 43 rotates toward the striker 30.

Figure 5:
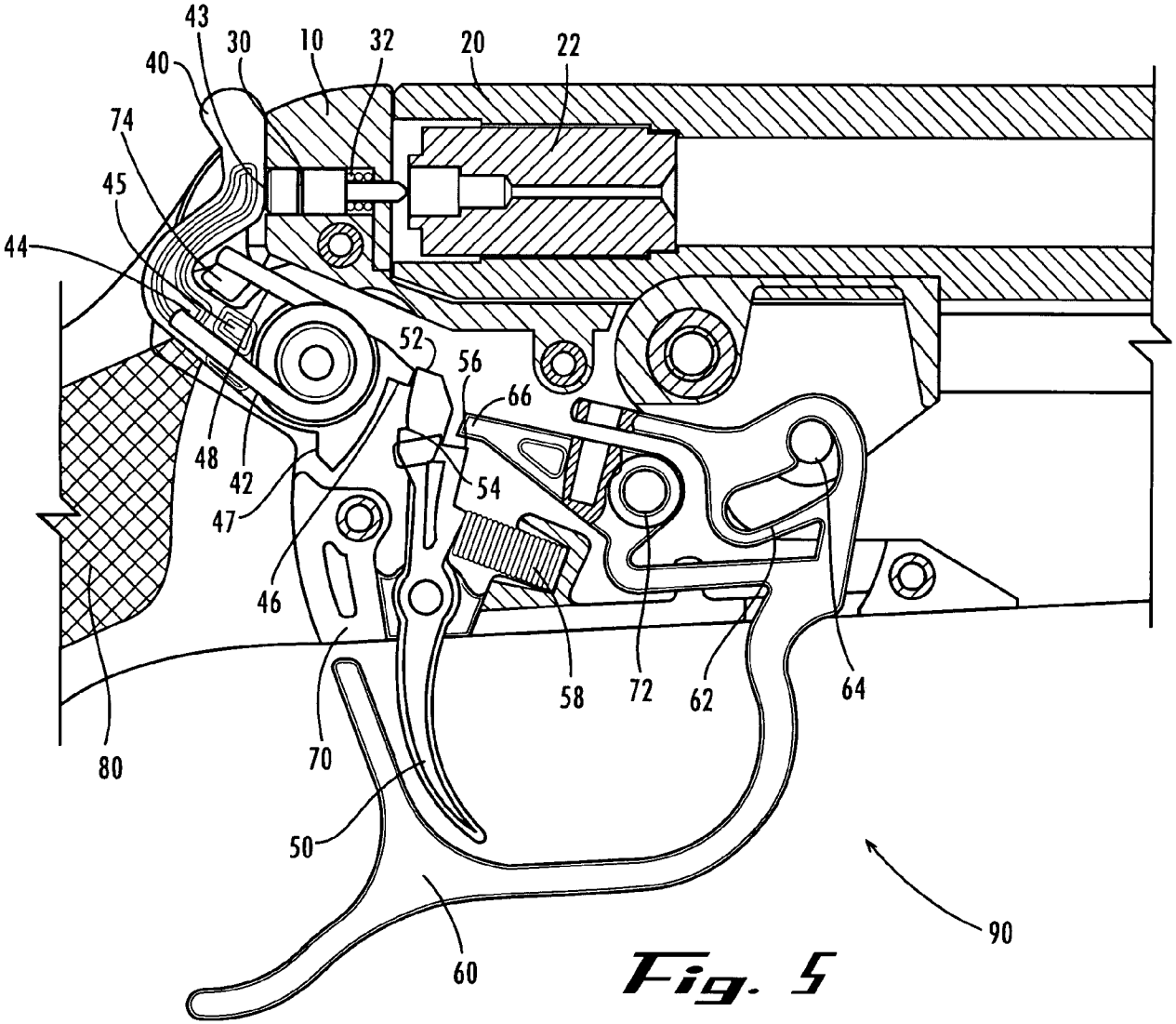
FIG. 5 is a side view of the pivoting firing mechanism of FIG. 1, showing the pivoting mechanism set closed or blocked and showing the post-shooting hammer position.

As shown in FIG. 5, which is a lateral view of the firing mechanism 10 of FIG. 1 in the closed position just after shooting, the hammer striker portion 43 comes in contact with the striker 30 in a rapid fashion which has sufficient kinetic energy to cause the compression of the striker spring 32. If a percussion cap, or the like, had been placed between the striker 30 and the breach plug 22 in the barrel 20, the percussion cap fires, igniting any gunpowder charge located on the opposite (forward) side of the breech plug 22.

It should be noticed that the setback uncocking support 48 is in contact with the second portion of the hammer spring 42 which provides a loading of the hammer 40 to return to the uncocked position, as shown in FIG. 1. Additionally the trigger spring 52 is loaded, and provides a loading of the trigger uncocked lever 52 to return to the uncocked position as shown in FIG. 1. Therefore, after shooting the firearm 90, the firing mechanism 10 returns to the uncocked position as shown in FIG. 1.

It should be understood that when the user wishes to perform a complete cleaning of the firing mechanism 10, the stock 80 can be taken off of the barrel 20 by unscrewing the bolt(s) (not shown) that connect(s) these parts together. The firing mechanism 10, which preferably is securely joined to the barrel 20 by the pivoting axle 75 and blocking axle 64, can be accessible for cleaning purposes.

It should also be appreciated that the present invention also substantially eliminates or minimizes the dangers of blowback gas reaching the face of the shooter, as the breech plug 22 is axially assembled in the barrel 20, and when the firing mechanism 10 is not pivoted down and unblocked, the pivoting firing mechanism 10 completely closes off the rear portion of the barrel 20. This closing is achieved in part by the base 70 of the firing mechanism 10 and the location of the lineal striker 30, which not only decreases the risk of blowback gas reaching the shooter, it also prevents debris and rainwater from reaching the percussion cap.

While it is preferable that the trigger guard 60 "guard" the trigger 50, the trigger guard 60 need not be an actual guard, but the term in the present specification includes any structure or means that allows the user of the firearm 90 to pivot the firing mechanism 10. This can include, for example, a knob, handle or the like. It should also be noted that the trigger guard need not be a single piece or rigid piece of metal, and some internal "bending" could be allowed to facilitate the blocking and unblocking of the trigger guard 60, and therefore allow for the controlled pivoting of the firing mechanism 10 as discussed herein. The trigger guard can be formed from a single piece of metal or as multiple parts.

Additionally, when using the term "barrel" 20 in the present specification, the term includes not only the "tube" or bored out rod for which the bullets, or the like, are placed, but also the fixed periphery parts including, without limitation, the pivoting junction axle 75 and the blocking axle 64.

Referring now to FIGS. 6–12, the reader's attention is directed to the second preferred form of the invention similar to the first in many respects. However, in this second embodiment (in comparison to the first described embodiment), the mechanism guiding movement of the trigger guard relative to the pivot block has been simplified, the biasing spring biasing the trigger guard toward its locked position has been replaced with a spring clamp, and the firing pin has been refined.

Figure 6:
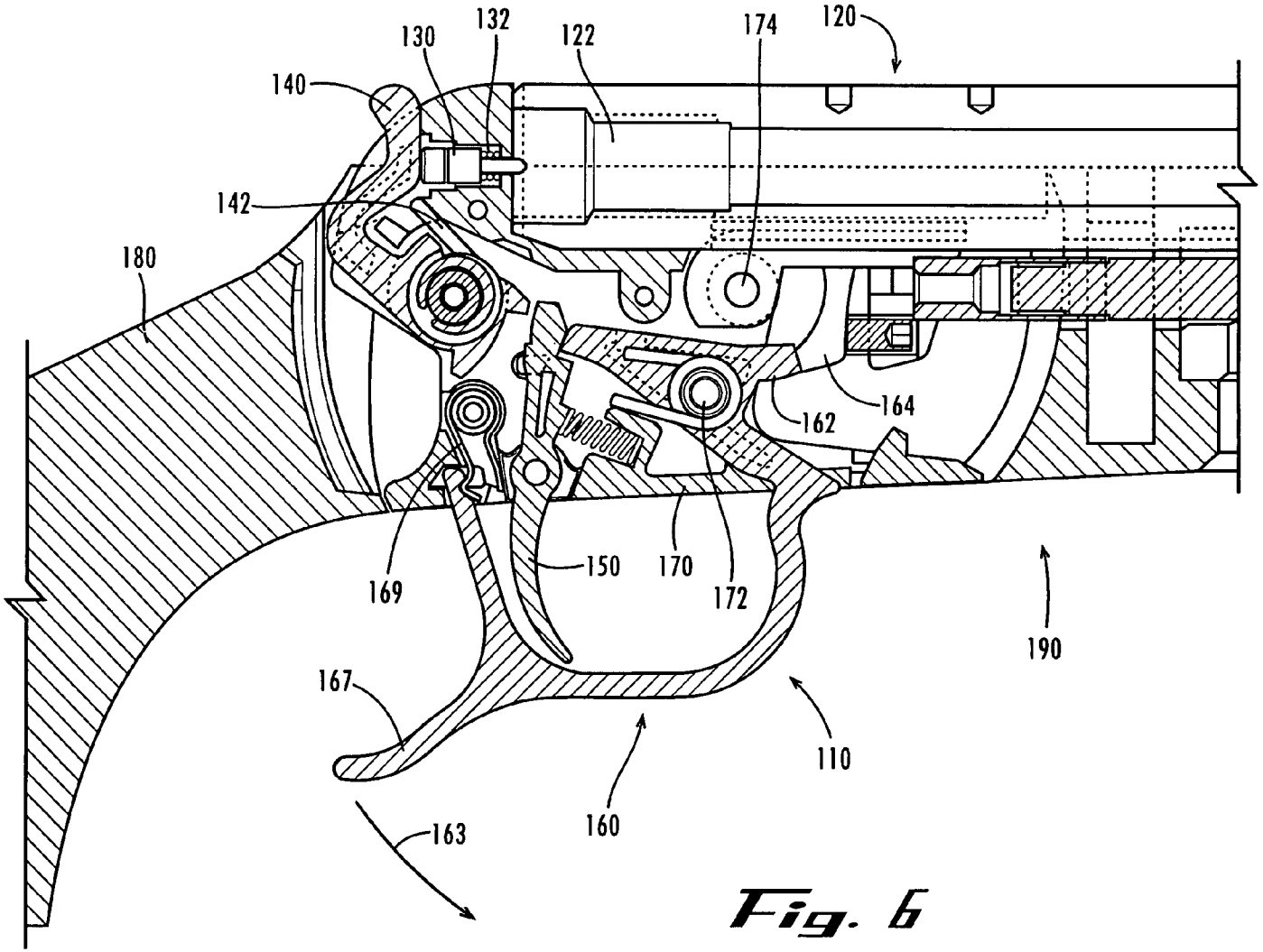
FIG. 6 is a side view of an example of a muzzle-loading firearm of the present invention in a second preferred form, showing its pivoting firing mechanism in a closed or post-shooting position, where the hammer is also not cocked.
Figure 7:
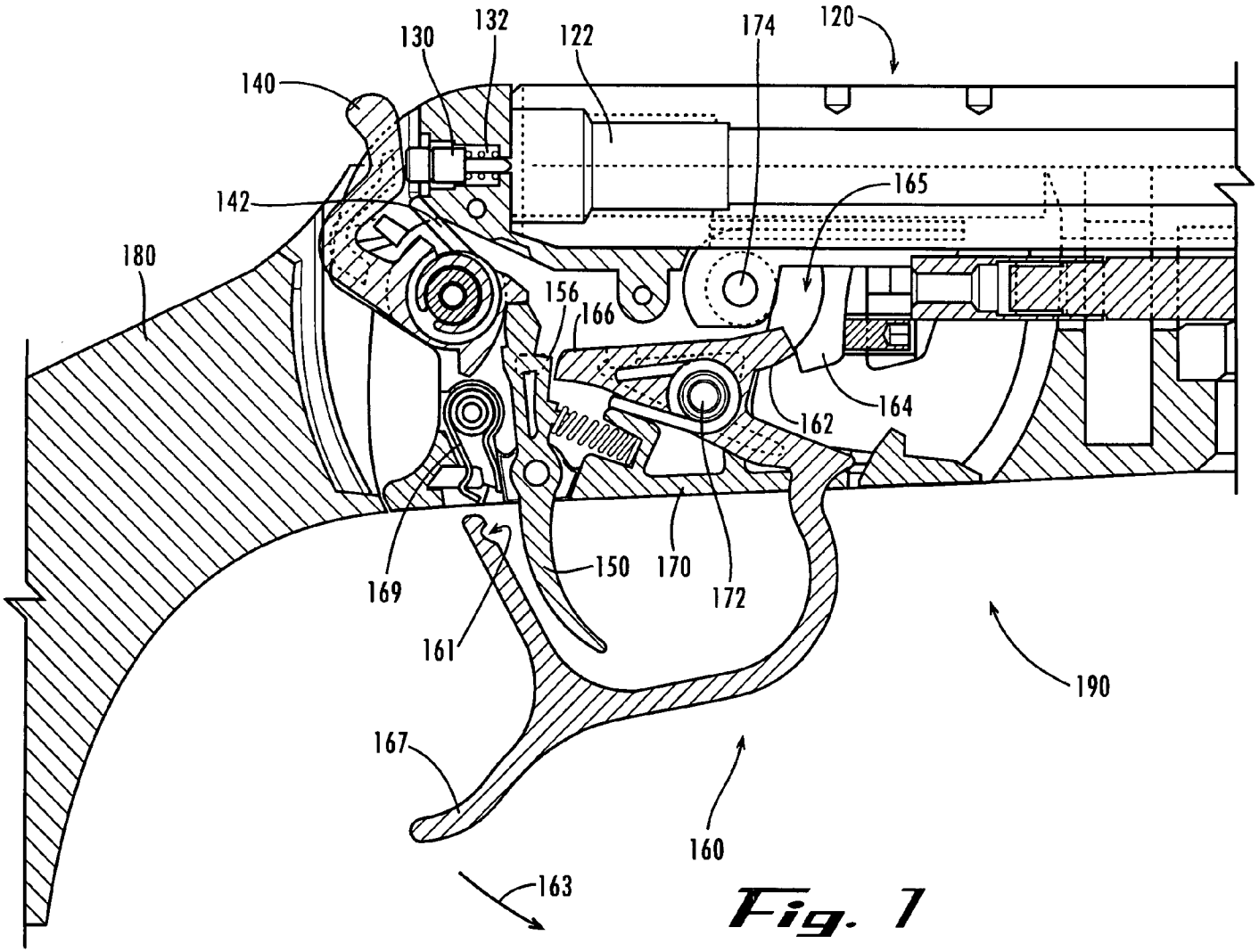

FIG. 6, which is a lateral view of an example of the present invention with a pivoting firing mechanism in a closed or uncocked position, shows a firearm 190 which preferably has a firing mechanism 110, a barrel 120 and a stock 180. The barrel 120 has a front end (not shown) and a back end. At the back end of the barrel 120 a breech plug 122 is inserted therein. The stock 180 is attached at one or more points (not shown) to the barrel 120.

Like the first embodiment, the firing mechanism 110 preferably includes a lineal striker or firing pin 130 and a striker spring 132. As shown, when in the closed position, the striker 130 is aligned with the breech plug 122, and the striker spring is located between the striker 130 and the breech plug 122, to ensure return of the striker 130 to the position shown in FIG. 6 after shooting the firearm 190.

As in the first embodiment, the firing mechanism 110 preferably also includes a hammer 140 and a hammer spring 142. The hammer 140 has a strike portion that contacts the striker 130 when the hammer is released forward upon firing the firearm 190.

Like the first embodiment, the firing mechanism 110 preferably also includes the various parts that operate and selectively lock and unlock the trigger 150. A description of all those parts need not be repeated here.

The firing mechanism 110 preferably also includes a trigger guard 160. The trigger guard 160 is pivotally mounted to a base 170 at a pivot axle 172. In turn, the base 170 is pivotally mounted to the barrel 120 at axle 174. The trigger guard 160 includes a pawl or foot 162 which selectively engages (or disengages from) a fixed barrier or dog 164. When the trigger guard 160 is in the position shown here in FIG. 6, the foot 162 engages the fixed barrier 164, thereby preventing the base 170 from rotating from the position depicted. Thus, the foot 162 engaging the fixed barrier 164 effectively locks the base 170 (and the rest of the firing mechanism 110) in this locked, blocked configuration shown in this figure. Advantageously, the engagement between foot 162 and the fixed barrier 164 is aligned with the axle 172 such that unwanted movement of the trigger guard 160 from this locked position is prevented. This feature effectively prevents forces resulting from the combustion of the powder from unwantedly forcing the pivoting firing mechanism 110 open (toward the unblocked configuration). This helps to maintain a good seal at the rear of breech plug 122, thereby helping to keep combustion gases from venting in uncontrolled paths. To hold the trigger guard 160 in this locked position of FIG. 6, a spring clamp 169 is provided. The spring clamp 169 has a crook 168 formed in one end thereof for engaging a notch or detent 161 formed in part of the trigger guard 160. This spring clamp/detent arrangement advantageously holds the trigger guard 160 rather securely against inadvertent movement from the locked position of FIG. 6. However, the spring clamp/detent can be easily overcome by the user rotating the trigger guard 160 in the direction of direction arrow 163 by applying a little downward force on the handle end 167 of the trigger guard 160.

Figure 7:
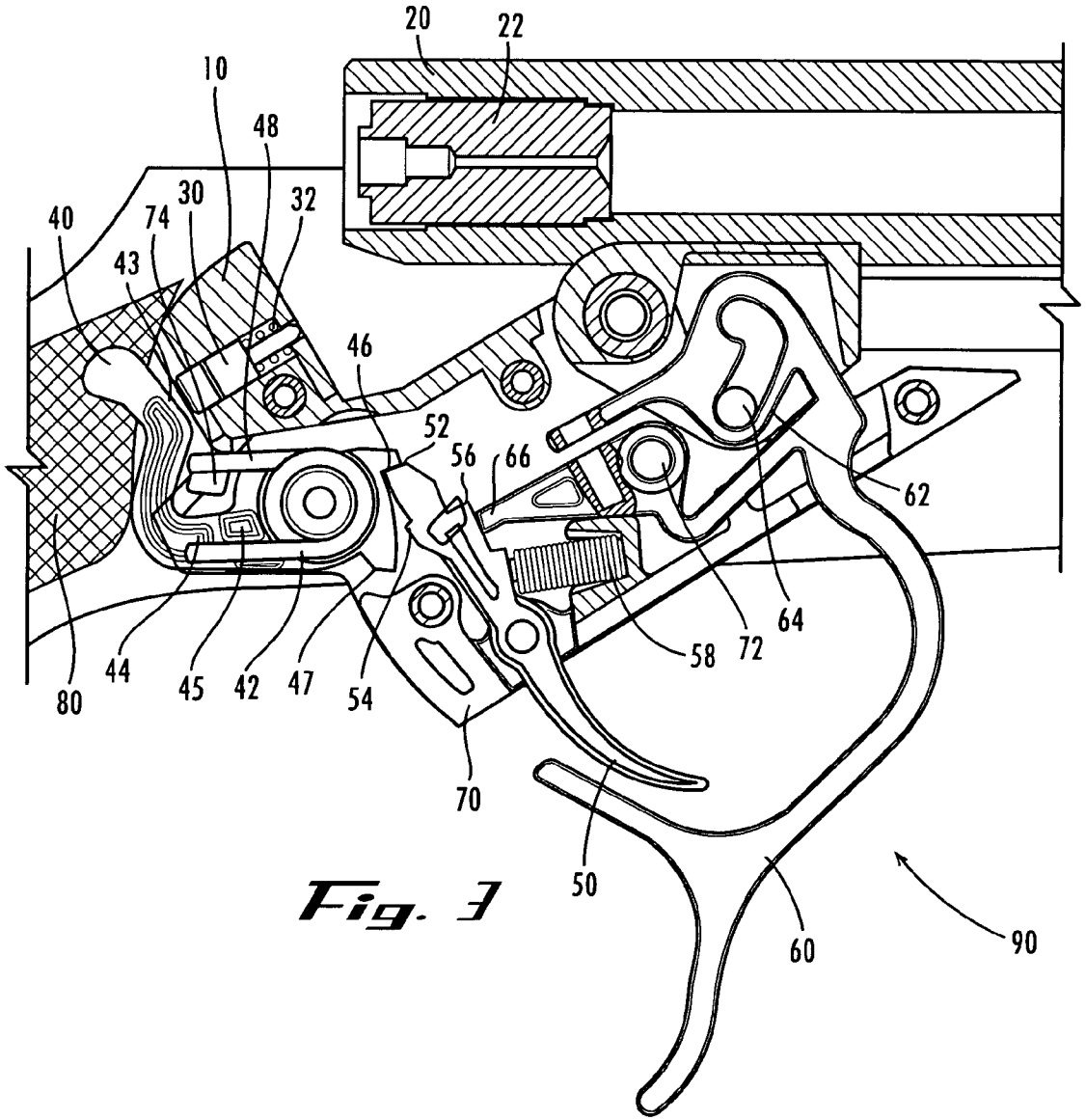
FIG. 7 is a side view of the pivoting firing mechanism of FIG. 6, showing the pivoting mechanism set unlocked and ready to be unblocked.

As shown in FIG. 7, when the pivoting firing mechanism 110 is unlocked by rotating the trigger guard 160 about the pivot axle 172 so that it is in the position depicted, the trigger guard safety lever 166 aligns with the top portion 156 of trigger 150, thereby preventing the trigger from being pulled. Thus, as shown in FIG. 7, the trigger guard 160 is unlocked, which has the effect of locking the trigger 150. Also, it should be noted that from this unlocked position, the trigger guard 160 can be rotated further in the direction of direction arrow 163 with relative ease. This is so because with the spring clamp 169 no longer engaging the detent 161, the spring clamp exerts no force on the trigger guard (unlike the first embodiment described above where the return spring constantly biases the trigger guard toward a closed or blocked position). Thus, continued downward force on the handle end 167 of the trigger guard 160 causes it (and the pivoting firing mechanism 110) to move from the position of FIG. 7 to that of FIG. 8. This movement of the entire firing mechanism 110 is facilitated by the foot 162 clearing the fixed barrier 164 and being aligned with a curved pathway or curved slot 165. Thus, as the base 170 is rotated about the axle 174, the foot 162 rides in the curved slot 165.

Figure 8:
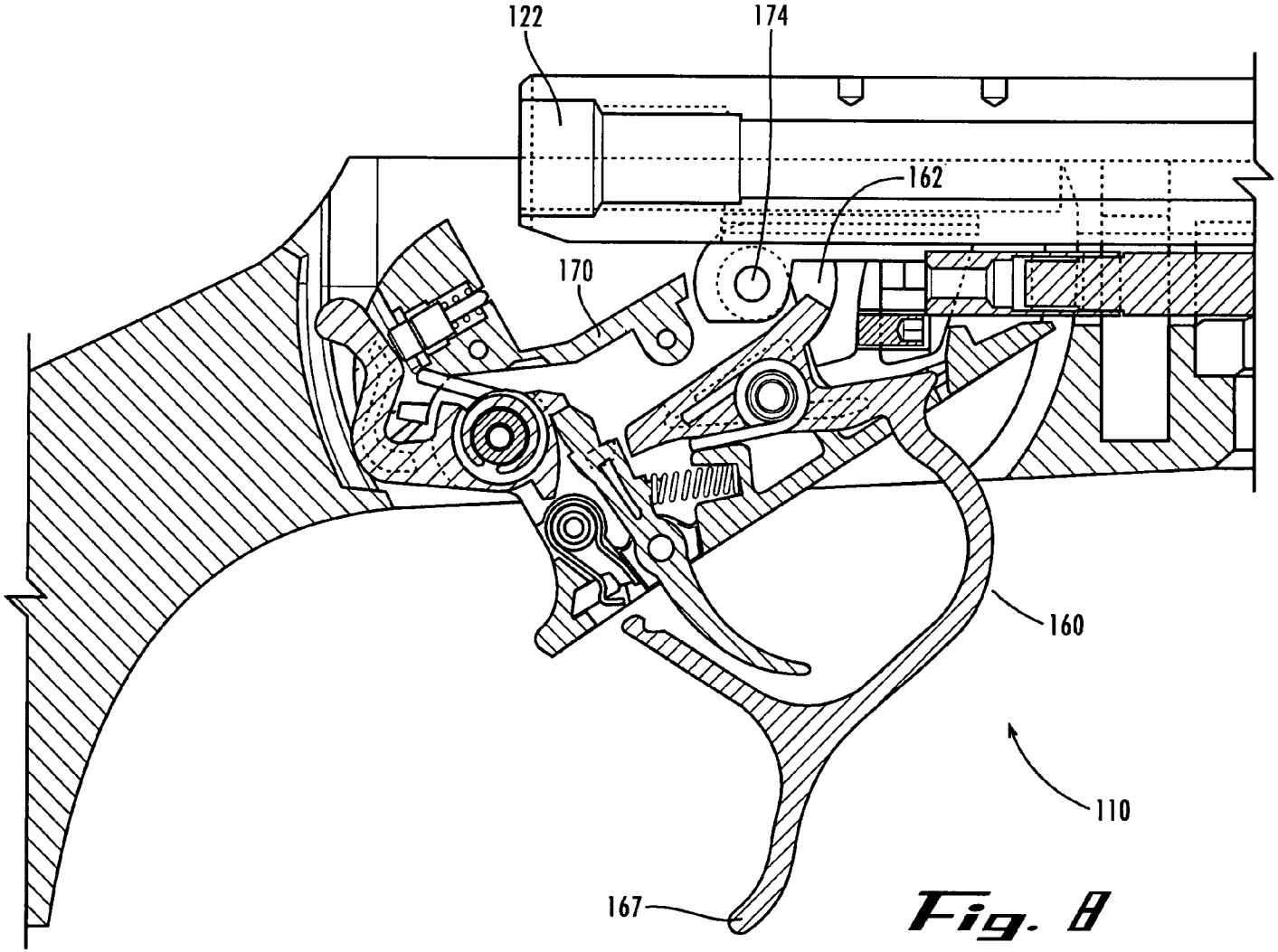
FIG. 8 is a side view of the pivoting firing mechanism of FIG. 6, showing the pivoting mechanism set totally unblocked (swung down).

FIG. 8 depicts the firing mechanism 110 when completely unblocked, with the foot 162 well within the curved slot 165. When in this position, it can be seen that there is essentially complete clearance for placement of a percussion cap (not shown) in the breech plug 122. When the firing mechanism 110 is swung down, the hammer cannot be cocked until the action is closed.

Figure 9:
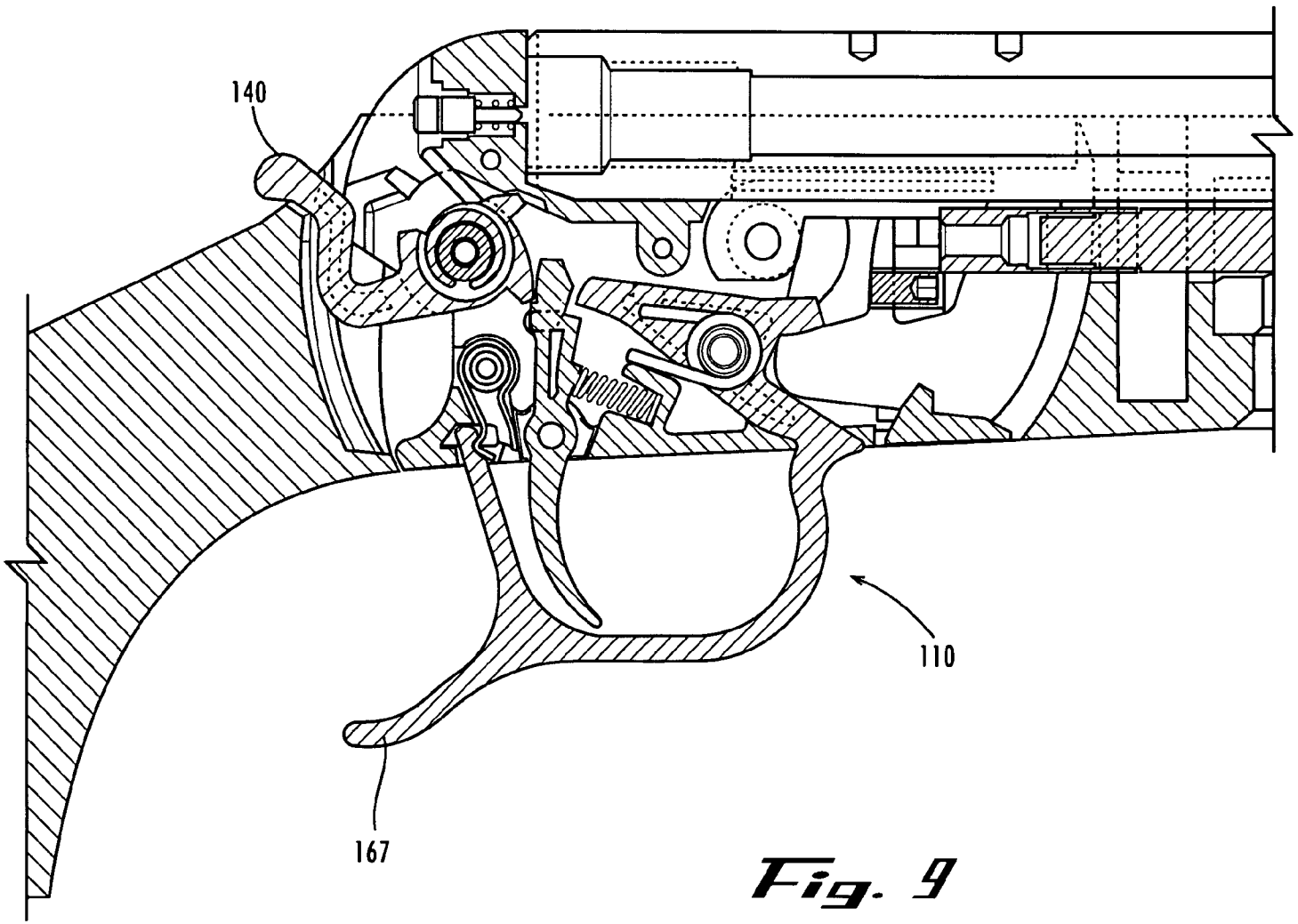
FIG. 9 is a side view of the pivoting firing mechanism of FIG. 6, showing the pivoting mechanism set closed or blocked and the hammer in a cocked position.

Upon examining FIG. 9 we can see the lateral view of the firing mechanism 110 of FIG. 6 when in the closed and cocked position. The hammer 140 is drawn back, fully loading its hammer spring. To move the firing mechanism 110 to this position from that of FIG. 8, the user would simply rotate the firing mechanism upwardly by pulling up on the trigger guard, such as on the handle portion 167 thereof, until the detent is captured by the crook formed in the spring clamp, and cock the hammer.

FIG. 10 is a lateral view of the firing mechanism 110 of FIG. 6 in the closed position just after shooting, wherein the hammer striker portion comes in contact with the striker in a rapid fashion and which has sufficient kinetic energy to cause the compression of the striker spring. If a percussion cap, or the like, had been placed between the striker and the breach plug 122 in the barrel 120, the cap would fire, igniting any gunpowder charge located on the opposite side of the breech plug 122.

Figure 11:
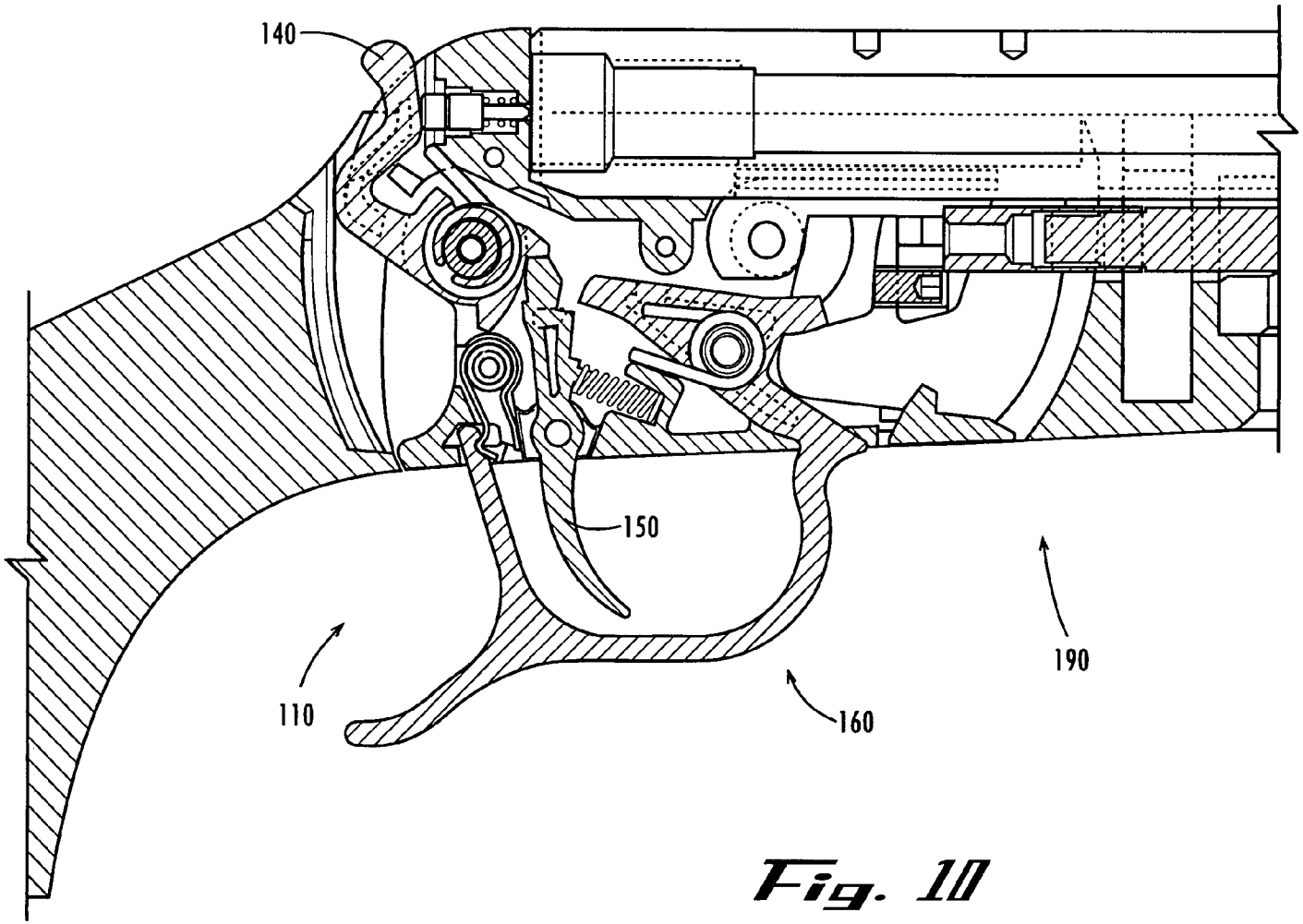
FIG. 11 is a perspective, partially exploded view of the pivoting firing mechanism of FIG. 6.
Figure 11:
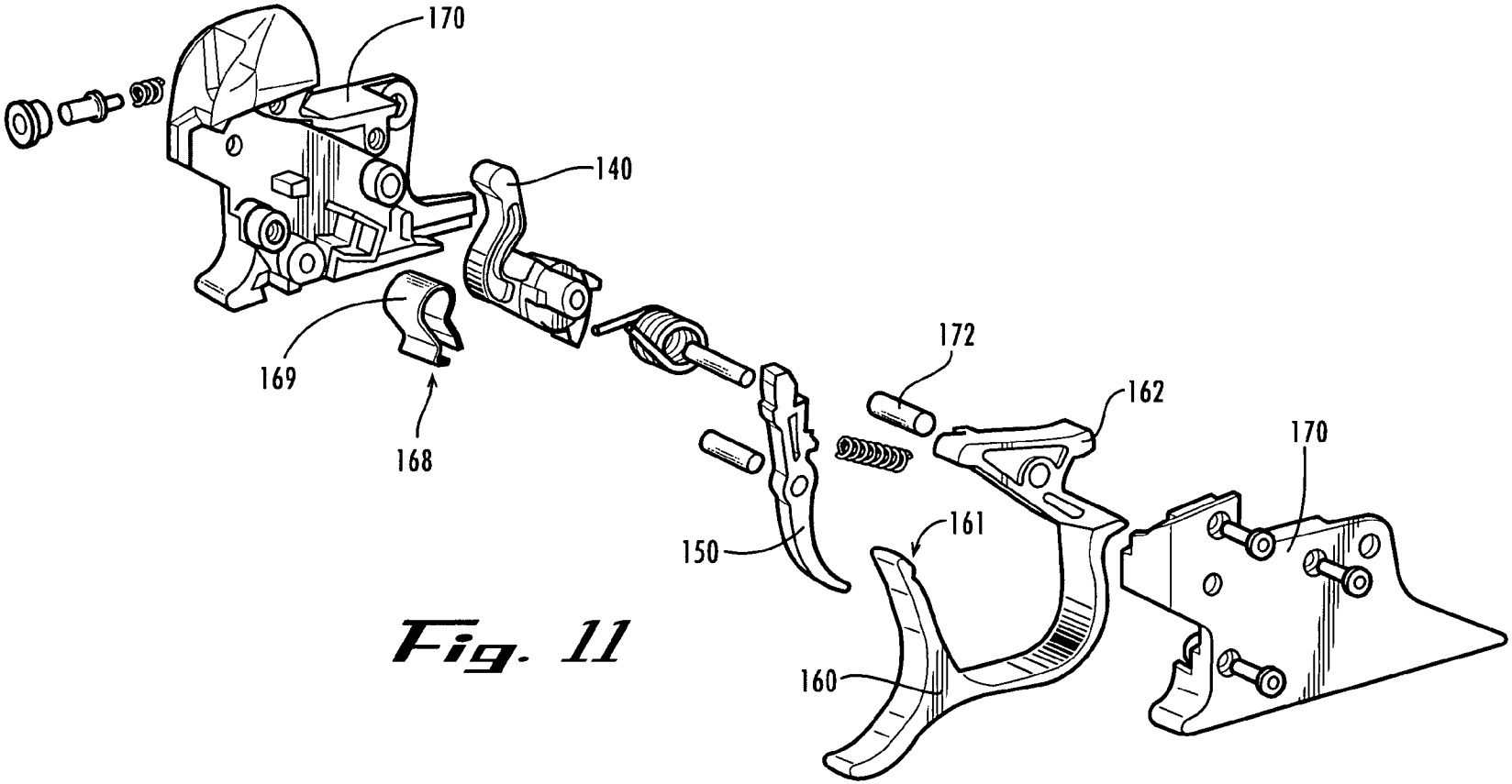
Figure 12A:
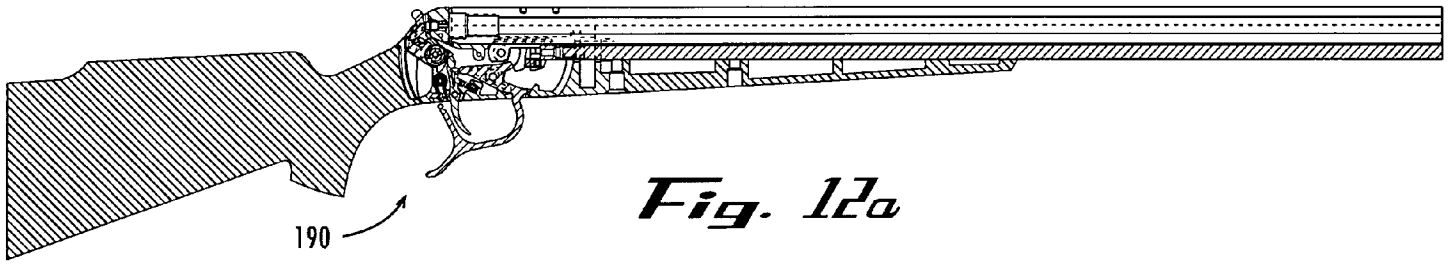
FIG. 12 is a series of side views of the pivoting firing mechanism of FIG. 6, showing the pivoting mechanism in use and depicting the movement of the various parts thereof.
Figure 12B:
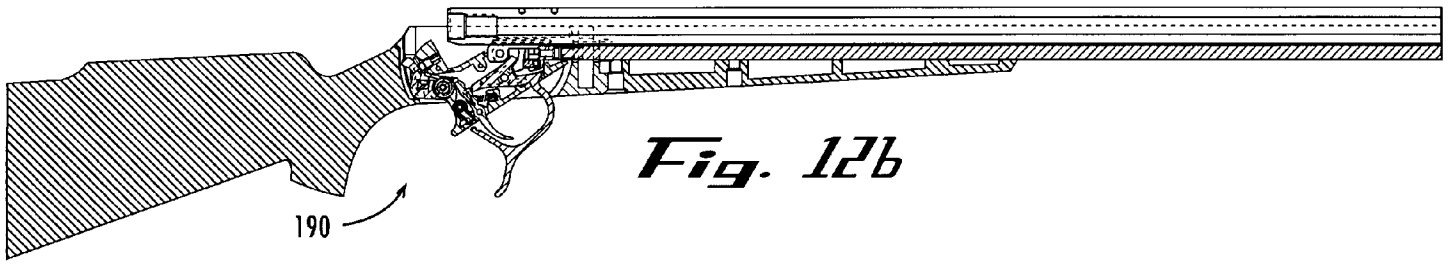
Figure 12C:
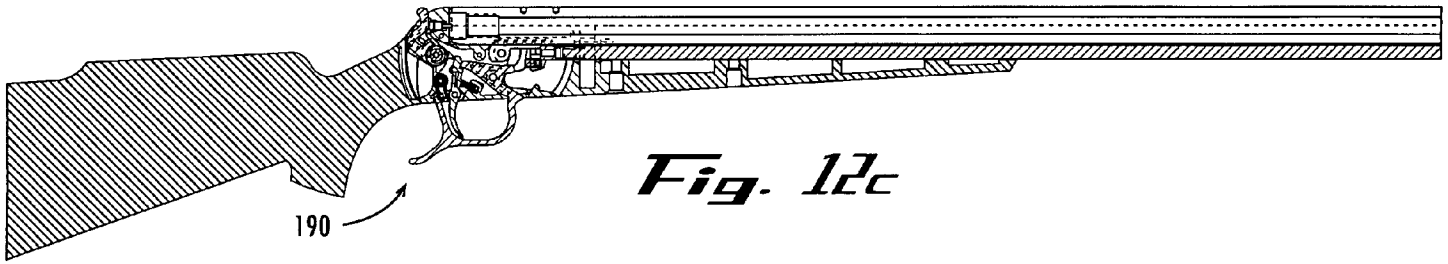
Figure 12D:
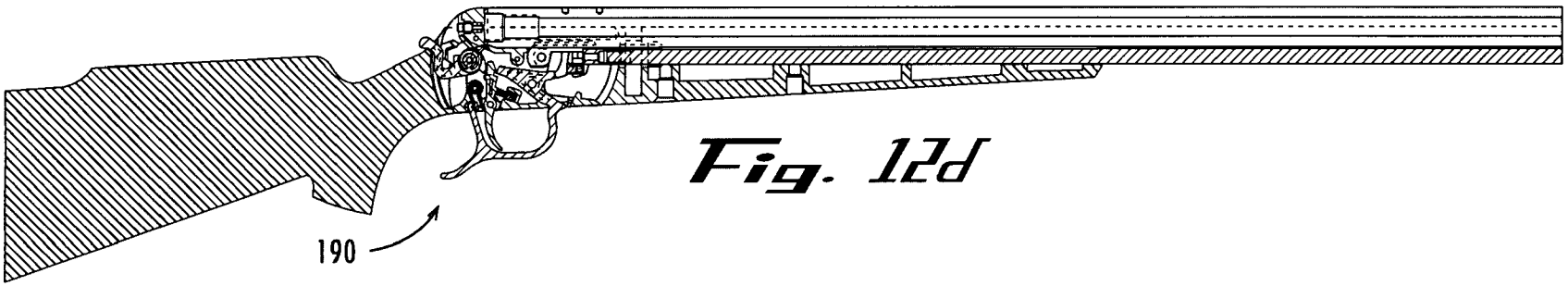
Figure 12E:
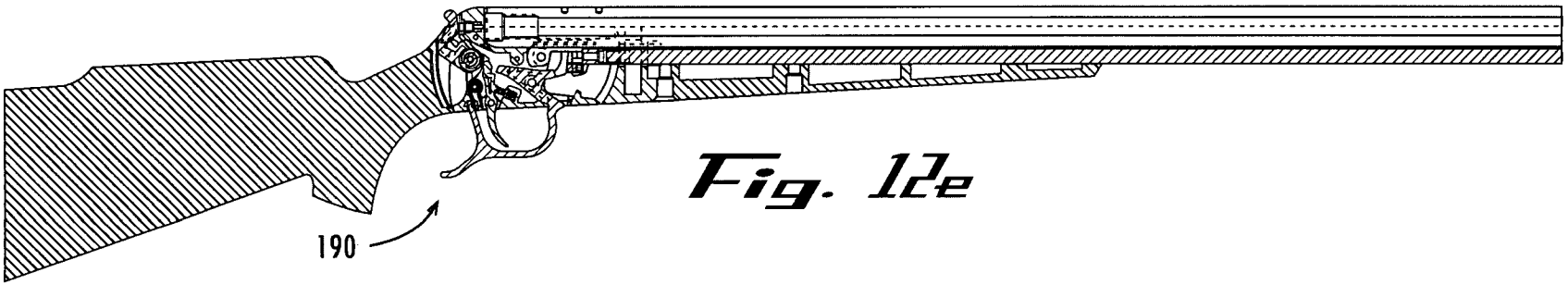

FIG. 11 is an exploded, perspective view of selected portions of the pivoting firing mechanism 110 and shows the two-piece base 170 which is pivotally mounted to the barrel (see FIG. 6 for this pivotal mounting). The trigger guard 160 is pivotally mounted within the base 170 about the pivot axle 172. The trigger guard includes the detent 161 to be captured at times by the spring clamp 169. The spring clamp 169 is fitted over a boss formed in the base 170 and includes the previously described crook 168.

FIG. 12 is a sequential series of side views showing the progression of the various parts in use as follows (from top to bottom):

(a) post-firing, with the trigger guard unlocked;
(b) trigger guard and the rest of the firing mechanism unblocked for cleaning and/or reloading;
(c) firing mechanism returned to blocked position, but hammer not cocked;
(d) firing mechanism blocked, hammer cocked—ready for firing; and
(e) post-firing, with firing mechanism blocked and trigger guard locked.

In view of the foregoing, it will be appreciated that the present invention avoids many of the drawbacks of prior muzzle-loading firearms by allowing for significant pivoting of the firing mechanism in relation to the barrel. The specific techniques and structures employed by the invention to improve over the drawbacks of the prior art and to accomplish the advantages described above will become apparent from the above detailed description of the embodiments of the invention and the appended drawings and claims. It should be understood that the foregoing relates only to the exemplary embodiments of the present invention, and that numerous changes may be made therein without departing from the spirit and scope of the invention as defined by the following claims.

The invention claimed is:

1. A muzzle-loading firearm comprising:

a barrel;

a breech plug situated in a rear end of the barrel and adapted to receive a percussion cap;

a pivoting block mounted for pivotal motion relative to the barrel and having a firing mechanism mounted thereto, the firing mechanism including a striker for striking the percussion cap, a hammer for driving the striker, and a trigger for tripping the hammer, the pivoting block being pivotal between a blocked position for firing and an unblocked position for providing access to the breech plug for removing a spent percussion cap and replacing it with a fresh percussion cap; and a trigger guard pivotally mounted to the pivoting block for movement between three positions:

a locked position locking the pivoting block in its blocked position;

an unlocked, blocked position in which the pivoting block is still in its blocked position, but the pivoting block is ready to be moved therefrom; and an unlocked, unblocked position in which the pivoting block has been unblocked, providing access to the breech plug, and wherein rotation of the trigger guard from the unlocked, blocked position to the unlocked, unblocked position causes the pivoting block to move from its blocked position to its unblocked position.

2. A muzzle-loading firearm as claimed in claim 1 wherein the trigger guard is held in its locked, blocked position by a spring clamp.

3. A muzzle-loading firearm as claimed in claim 2 wherein the spring clamp tends to hold the trigger guard in its locked, blocked position, but does not apply a biasing force biasing the trigger guard against movement from the unlocked, blocked position toward the unlocked, unblocked position.

4. A muzzle-loading firearm as claimed in claim 1 wherein the trigger guard is biased toward its locked, blocked position by a biasing spring.

5. A muzzle-loading firearm as claimed in claim 1 wherein the trigger guard, when in its unlocked positions, is operative to prevent the trigger from being operated.

6. A muzzle-loading firearm as claimed in claim 1 wherein the trigger guard, when in its locked, blocked position engages a fixed barrier to prevent the pivoting block from moving from the blocked position to the unblocked position.

7. A muzzle-loading firearm as claimed in claim 1 wherein as the trigger guard moves from its locked position to its unlocked, blocked position it pivots relative to the pivoting block and wherein as the trigger guard moves from its unlocked, blocked position to its unlocked, unblocked position, the trigger guard and the pivoting block pivot together relative to the barrel.

8. A muzzle-loading firearm comprising:

a barrel;

a breach plug situated in a rear end of the barrel and adapted to receive a percussion cap;

a pivoting block having a firing mechanism mounted thereto, the firing mechanism including a striker for striking the percussion cap, a hammer for driving the striker, and a trigger for tripping the hammer, the pivoting block being pivotal between a blocked position for firing and an unblocked position for providing access to the breech plug for removing a spent percussion cap and replacing it with a fresh percussion cap; and a lever movably mounted to the pivoting block for movement between a locked position locking the pivoting block in its blocked position, an unlocked, blocked position, and an unlocked, unblocked position, and wherein movement of the lever from the unlocked, blocked position to the unlocked, unblocked position moves the pivoting block from its blocked position to its unblocked position.

9. A muzzle-loading firearm as claimed in claim 8 wherein the lever comprises a trigger guard.

10. A muzzle-loading firearm as claimed in claim 9 wherein the trigger guard is pivotally mounted to the pivoting block.

11. A muzzle-loading firearm as claimed in claim 10 wherein the trigger guard is held in its locked, blocked position by a spring clamp.

12. A muzzle-loading firearm as claimed in claim 11 wherein the spring clamp tends to hold the trigger guard in its locked, blocked position, but does not apply a biasing force biasing The trigger guard against movement from the unlocked, blocked position toward the unlocked, unblocked position.

13. A muzzle-loading firearm as claimed in claim 8 wherein the lever is biased toward its locked, blocked position by a biasing spring.

14. A muzzle-loading firearm as claimed in claim 8 wherein the lever, when in its unlocked positions, is operative to prevent the trigger from being operated.

15. A muzzle-loading firearm as claimed in claim 8 wherein the lever, when in its locked, blocked position engages a fixed barrier to prevent the pivoting block from moving from the blocked position to the unblocked position.

16. A muzzle-loading firearm as claimed in claim 10 wherein as the trigger guard moves from its locked position to its unlocked, blocked position it pivots relative to the pivoting block and wherein as the trigger guard moves from its unlocked, blocked position to its unlocked, unblocked position, the trigger guard and the pivoting block pivot together relative to the barrel.

* * * * *